US005234210A

United States Patent [19]

Olexy

[11] Patent Number: 5,234,210

[45] Date of Patent: Aug. 10, 1993

[54] DIVERTER ASSEMBLY

[75] Inventor: Anthony M. Olexy, Honeoye Falls, N.Y.

[73] Assignee: Eastman Kodak Company, Rochester, N.Y.

[21] Appl. No.: 837,524

[22] Filed: Feb. 18, 1992

[51] Int. Cl.[5] ..... B65H 29/00

[52] U.S. Cl. ..... 271/184; 271/304

[58] Field of Search ..... 271/184, 225, 304, 314

[56] References Cited

U.S. PATENT DOCUMENTS

| | | | |
|---|---|---|---|
| 1,850,932 | 8/1928 | Holms | 271/303 |
| 2,164,436 | 7/1939 | Waters | 271/303 |
| 2,251,596 | 8/1941 | O'Malley | 193/39 |
| 2,526,916 | 10/1950 | Turrall | 271/64 |
| 3,472,506 | 10/1969 | Rabinow et al. | 271/64 |
| 3,724,657 | 4/1973 | Katagiri et al. | 209/74 |
| 3,931,920 | 1/1976 | Hellinger | 226/91 |
| 4,277,061 | 7/1981 | Nagel et al. | 271/302 |
| 4,351,492 | 9/1982 | Aoyama et al. | 242/18 |
| 4,416,378 | 11/1983 | Miller | 209/583 |
| 4,420,153 | 12/1983 | Winkler et al. | 271/304 |
| 4,538,800 | 9/1985 | Richter | 271/120 |
| 4,709,913 | 12/1987 | Cagey | 271/207 |
| 4,729,557 | 3/1988 | Kiyohara | 271/272 |
| 4,767,114 | 8/1988 | Nishimoto | 271/3 |
| 4,785,942 | 11/1988 | VanLeijenhorst et al. | 209/657 |
| 4,874,958 | 10/1989 | Sampath et al. | 355/309 |
| 4,917,283 | 4/1990 | Weatherhead et al. | 226/190 |
| 4,958,828 | 9/1990 | Saito | 271/186 |
| 4,959,685 | 9/1990 | Kato | 355/72 |
| 5,088,722 | 2/1992 | Olexy | 271/304 |

FOREIGN PATENT DOCUMENTS

| | | | |
|---|---|---|---|
| 407151 | 9/1991 | European Pat. Off. . | |
| 60-228352 | 11/1985 | Japan . | |
| 185769 | 8/1988 | Japan | 271/184 |
| 1-156272 | 6/1989 | Japan . | |
| 1-252457 | 10/1989 | Japan . | |
| 1-308355 | 12/1989 | Japan . | |
| 897194 | 5/1962 | United Kingdom . | |

*Primary Examiner*—Robert P. Olszewski
*Assistant Examiner*—Boris Milef
*Attorney, Agent, or Firm*—Frank Pincelli

[57] ABSTRACT

A diverting apparatus for diverting successive sheets from an entrance path in one of two different directions. The apparatus comprises a driven diverter roller having a plurality of spaced gripping sections for urging the sheets through the diverting apparatus. A pair of primary idler rollers are provided, each being in direct contact with the driven diverter roller, so as to cause the idler rollers to rotate in the opposite direction the diverter roller is rotated. A second pair of idler rollers may be provided which are in direct contact with the primary idler rollers which provide a moving support guide which assists in controlling the path of the sheets passing through the diverting apparatus.

19 Claims, 5 Drawing Sheets

DIVERTER ASSEMBLY

FIELD OF THE INVENTION

The present invention relates to a diverter assembly that is particularly useful for handling sheets of material such as photographic film.

BACKGROUND OF THE INVENTION

Various kinds of diverter assemblies are known for redirecting a sheet of material from one path into another path while the sheet is being transported through a mechanism. Diverters for non-photographic sheets are known from U.S. Pat. No. 3,472,506, issued Oct. 14, 1969. It is also known to provide mechanisms which cause film to be diverted from its current direction of movement into a different path with a "gating" device to deflect the film into the desired direction of travel. Applicant, in U.S. Pat. No. 5,008,722 issuing on Feb. 18, 1992, teaches the use of a mechanism which utilizes a rotating grooved roller to capture the leading edge of the film and direct it into one of two potential paths of travel. These mechanisms suffer from various deficiencies. These devices have the potential to cause the sheet to momentarily "stub" as it is being diverted. This may result in either a delay in the movement of the film, or a film jam at the location of the diverter. In addition, the prior devices have an inherently high probability of scratching the film on either the diverter, or the adjacent guide as it is being deflected into its new direction of travel.

Applicant has invented an improved diverting apparatus which minimizes the stubbing effect experienced in prior devices, and also, minimizes the possibility of scratching the film on either side of the diverter as it travels through the diverter.

SUMMARY OF THE INVENTION

In one aspect of the present invention, there is provided a diverting apparatus for diverting successive sheets from an entrance path in one of two different directions. The apparatus comprises a driven diverter roller having a plurality of spaced gripping sections. The gripping sections each have an outer engaging surface having means for urging the sheets through the diverting apparatus. A pair of primary idler rollers are provided, each being in direct contact with the driven diverter roller, so as to cause the idler rollers to rotate in the opposite direction the diverter roller is rotated. The primary idler rollers are positioned with respect to the entrance path such that a sheet traveling along the entrance path passes between the primary idler rollers.

In another aspect according to the present invention, a diverting apparatus is provided for diverting successive sheets, such as film, from an entrance path in one of two directions. The diverting apparatus comprises a driven diverter roller, a pair of spaced primary idler rollers which are in direct contact with the driven diverter roller, and means for providing a moving support guide which assists in controlling the path of the sheets passing through the diverting apparatus.

BRIEF DESCRIPTION OF THE DRAWINGS

In the detailed description of the preferred embodiment of the invention as presented below, reference is made to the accompanying drawings, in which.

DETAILED DESCRIPTION OF THE PREFERRED EMBODIMENT

Figure 1:
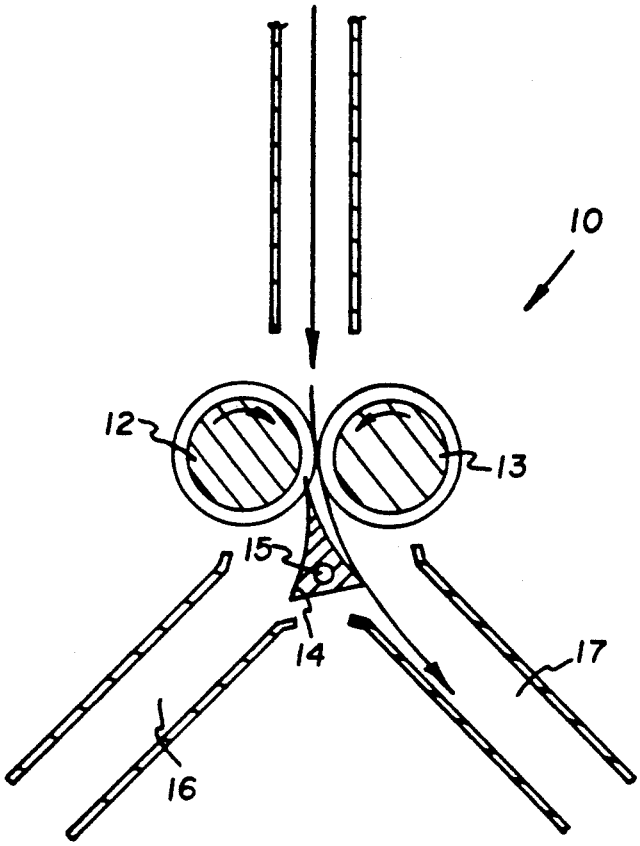
FIG. 1 is a view showing a prior art diverter assembly positioned to receive a sheet delivered along an entrance path and to deflect the sheet into either of two exit paths.

Referring to FIG. 1, there is illustrated a diverter assembly 10 of the prior art which is used to direct a sheet in one of two directions. The diverter assembly 10 includes a pair of drive rollers 12,13 through which a sheet of film, for example, is passed. The apparatus further comprises a gate 14 which is rotated about pivot point 15 and is used to direct the film to exit path 16 or 17. As illustrated, the gate 14 is positioned to direct a sheet of film to exit path 17. By rotating the gate 14 so that it rests against roller 13, the sheet would be caused to be fed to path 16.

Figure 2:
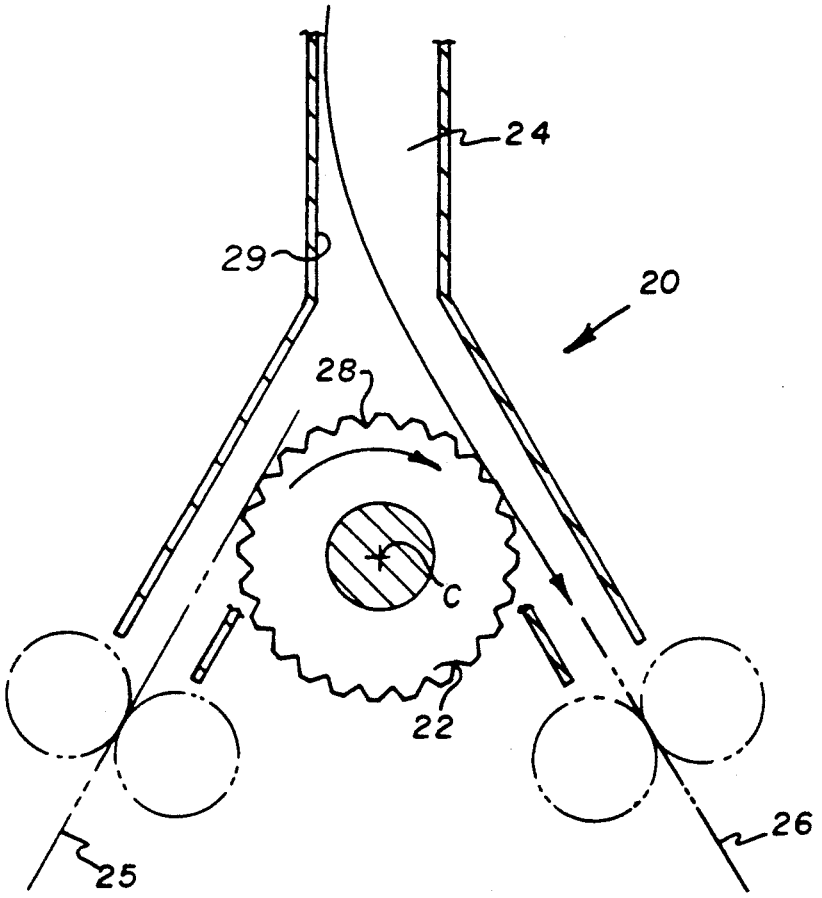
FIG. 2 (PRIOR ART)
FIG. 2 is a view showing a diverter assembly not of this invention, positioned to receive a sheet delivered along an entrance path and to deflect the sheet into either of two exit paths.

Referring to FIG. 2, there is illustrated a diverter assembly 20 as shown in applicant's U.S. Pat. No. 5,088,722 noted above, which comprises a driven diverter roller 22 designed to redirect a sheet from an entrance path 24 to one of two exit paths 25,26. The diverter roller may rotate in either axial direction about center C. The outer surface of the diverter roller 22 is provided with a plurality of parallel grooves 28 formed in the outer surface which extends the length of the roller. The operation of this device is described in more detail in said U.S. Pat. No. 5,088,722, which is hereby incorporated by reference. While this device has been found to provide an improvement in the handling of photographic film with a high degree of reliability, there exists the possibility that a sheet will temporarily stub itself on the top surface of the diverter roller. If the film is bowed in a direction perpendicular to the length of the grooves, it is possible that the sheet may be temporarily hung on top of the diverter roller instead of being in one of the grooves, and possibly cause a jam. Additionally, in this configuration, there is a risk that the film may be scratched as it rubs against the guide surfaces 29 through which the film must pass.

Figure 4:
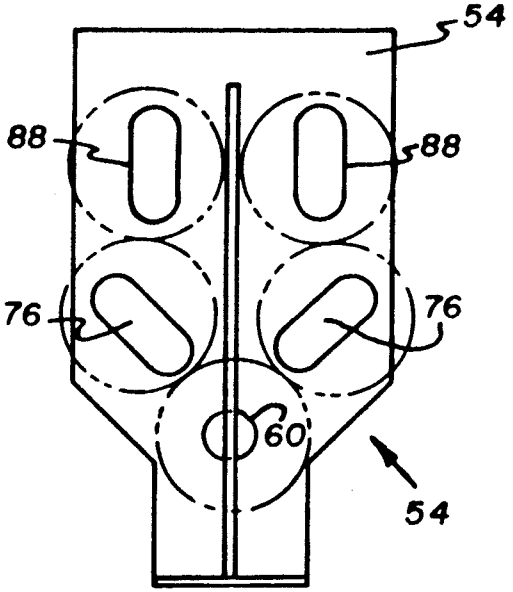
FIG. 4 is a side elevational view of one of the two mounting brackets used to support rollers of a diverter assembly.
Figure 3:
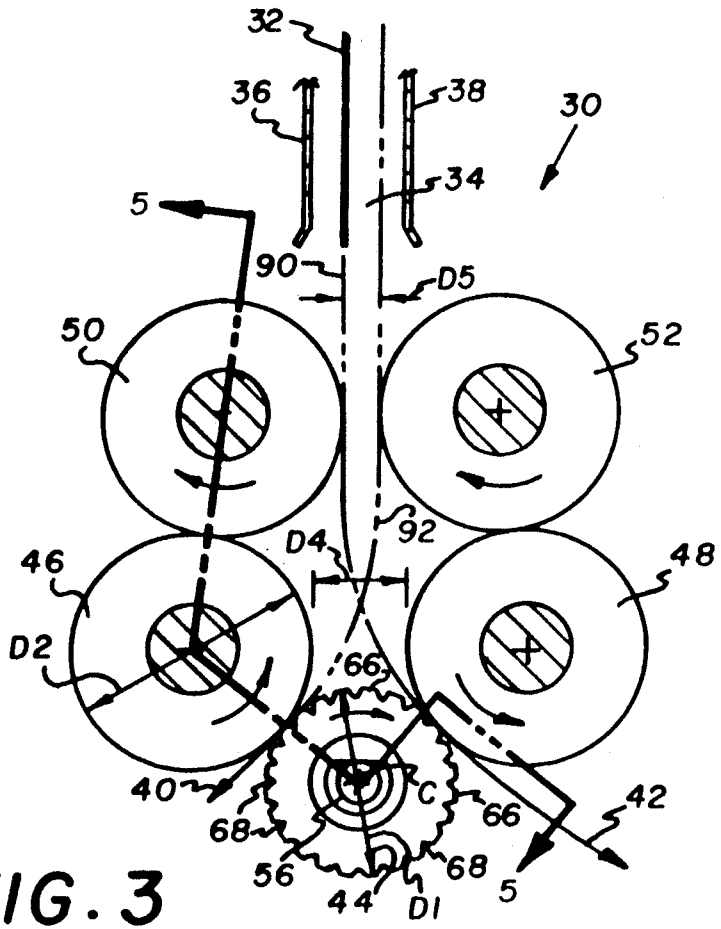
FIG. 3 is a view showing a diverter assembly made in accordance with the present invention positioned to receive a sheet delivered along an entrance path and to deflect the sheet into either of two exit paths.
Figure 5:
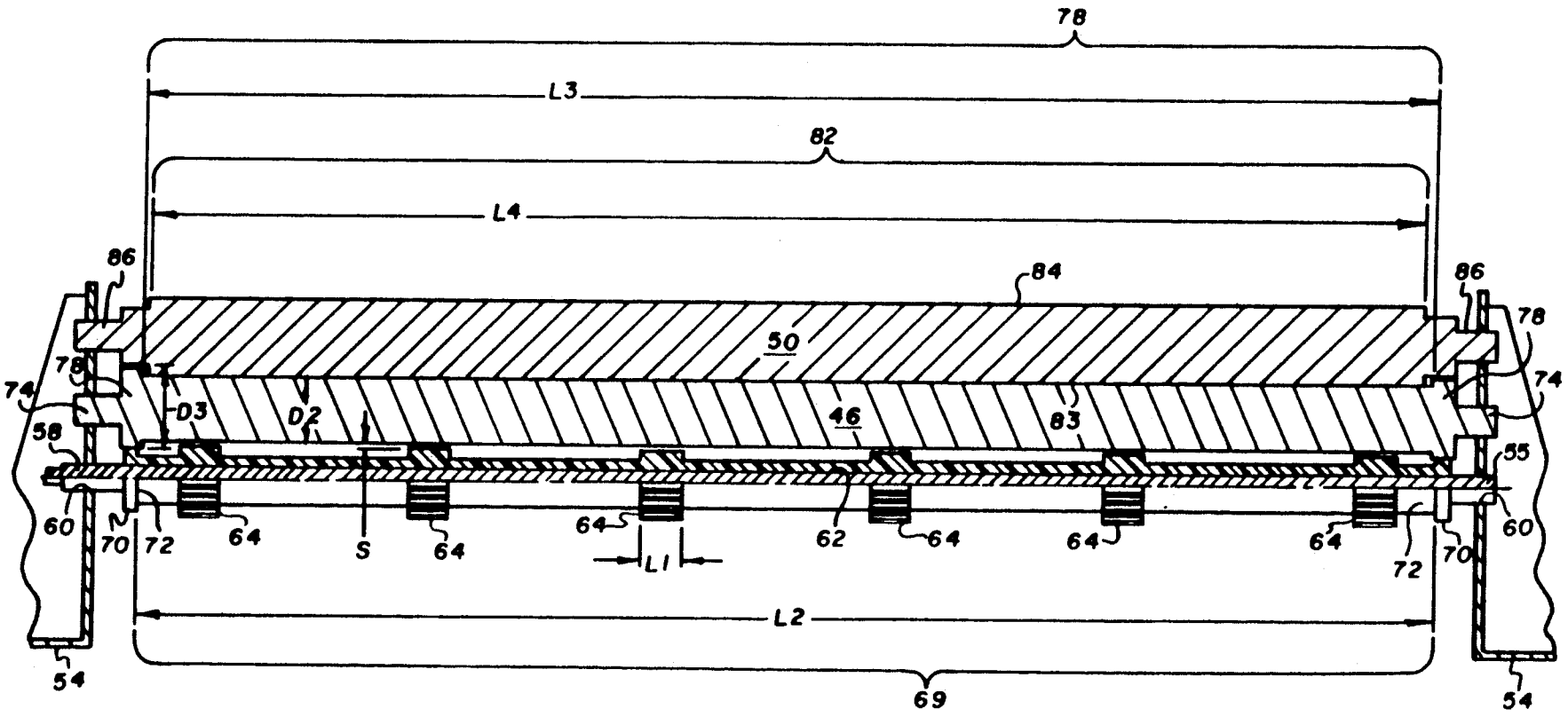
FIG. 5 is a cross-sectional view of the diverter assembly of FIG. 3 as taken along line 5—5.
Figure 6:
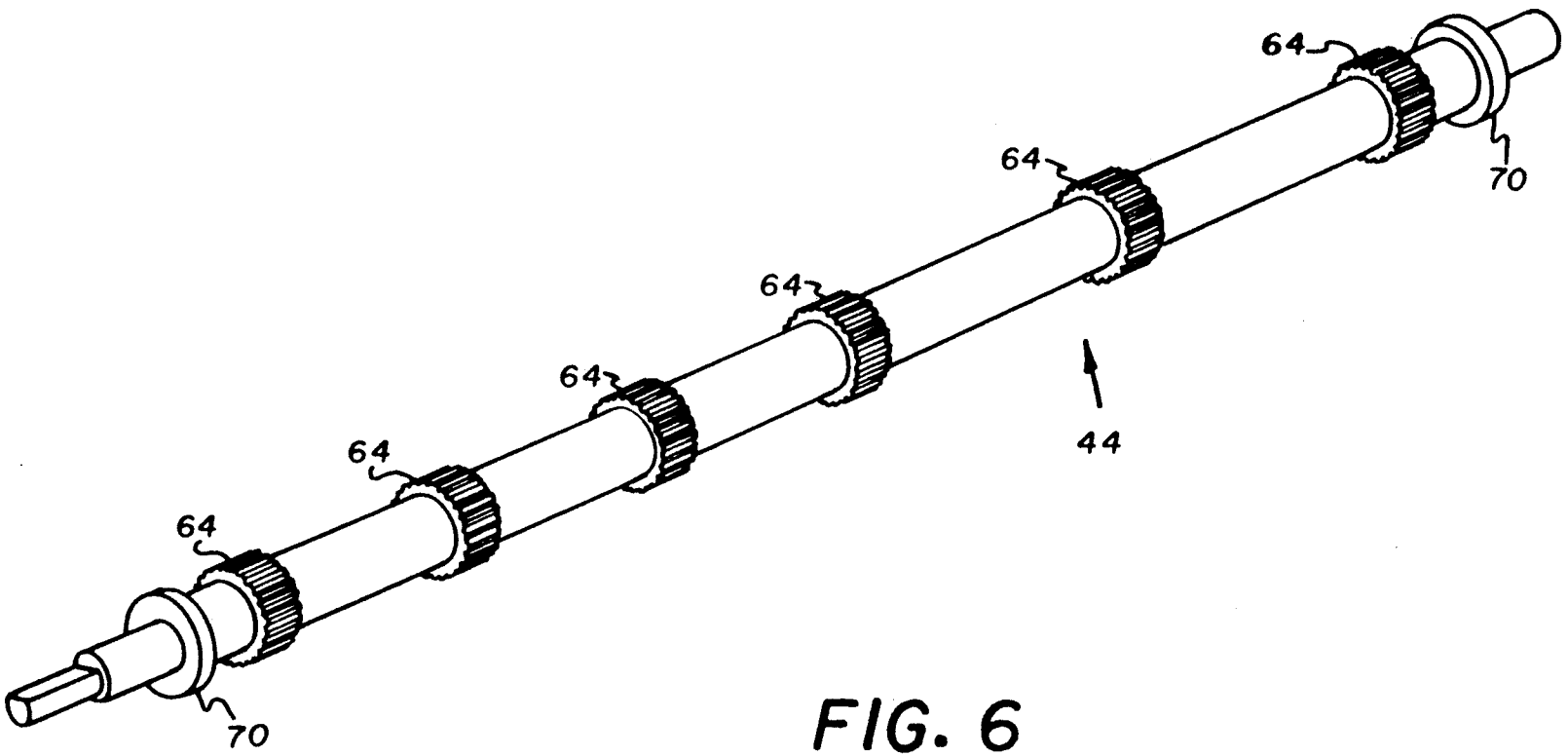
FIG. 6 is a perspective view of a divert roller of the diverter assembly of FIG. 3.

Referring to FIGS. 3–5, there is illustrated a diverter assembly 30 made in accordance with the present invention, which is adapted to receive a sheet 32, such as film, moving along an entrance path 34, defined by a pair of film guides 36,38. Diverter assembly 30 can deflect a sheet 12 in either of two exit paths 40,42 as explained in more detail later.

Diverter assembly 30 comprises a driven diverter roller 44, a pair of primary idler rollers 46,48 and a pair of secondary idler rollers 50,52. The rollers 44,46,48,50,52 are rotatably mounted to a pair of axially spaced support members 54 such that the axes of the rollers are substantially parallel to each other as illustrated in FIGS. 3 and 5. The support members 54 may be secured in any desired manner to the frame, at predetermined spaced distance, of a device in which the diverter assembly is used.

The diverter roller 44 comprises a substantially cylindrical inner support core 56 which is preferably made of metal. The inner support core 56 has a pair of outer ends 58 which are rotatably mounted to side support members 54 through a pair of axially aligned openings 60, one provided in each side support member 54. The diverter roller includes an outer layer 62 which is preferably made of a rubber material that has been integrally formed thereon. In the particular embodiment illustrated, the outer layer 62 has been formed on core 56 through the use of normal molding techniques. Preferably layer 62 is made of a material having a high coefficient of friction. In the particular embodiment illustrated outer layer 62 is made of polyurethane material. The outer layer 62 is shaped so as to provide a plurality of gripping sections 64 spaced along the axis of the diverter roller 44. The gripping sections 64 each have a substantially circular cross-sectional configuration, and have an outer diameter D1. In the embodiment illustrated, D1 is ¾ of an inch (1.905 cms) the gripping sections 64 each have an outer engaging surface 66 which is provided with a plurality of substantially equally spaced parallel grooves 68 which extend the axial length L1 of gripping section 64, and are oriented in a direction substantially parallel to the axis of the diverter roller 44. The grooves 68 of each gripping section 64 are preferably in axially alignment with each other. In the particular embodiment illustrated, the grooves 68 have a generally V-shaped cross sectional configuration with the wide part of the groove adjacent the outer engaging surface 66 and having a width of about 0.05 inches (0.127 cms).

The diverter roller 44 is further provided with a pair of drive sections 70, one being disposed at each of the lateral ends 72 of the outer layer 62. Each of the gripping section 64 are designed such that the grooves 68 in gripping section 64 are free to independently engage the leading edge of a sheet passing through the diverter. The size and placement of the gripping section 64 are selected such that a sheet passing through the diverter assembly will engage at least two, preferably at least three, supporting gripping sections 64, yet are spaced far enough apart such that if the film is bowed in a direction perpendicular to the axis of the roller, the appropriate groove of each gripping section 64 will engage the film. Gripping sections 64 each have an axial length L1 which is preferably no greater than about 10% of the width of the smallest sheet designed to be passed through the diverter assembly and are preferably equally space along the length of the diverter roller. In the embodiment illustrated, the axial length L1 is about 5% of the smallest sheet designed to be passed through the diverter assembly. However, the gripping sections may spaced apart any desired distance along the diverter roller 44 as deemed appropriate for the size of the sheets to be passed through the diverter assembly. Thus, it is now possible that a bowed sheet of film may engage grooves 68 of adjacent gripping sections 64 which are not in axial alignment and thus reduce the possibility that the film will ride on the top of the diverter roller and thereby minimize or avoid stubbing of the sheet. In the particular embodiment illustrated, the diverter roller has a working section 69 designed to engage a sheet between drive sections 70. In the embodiment illustrated working section 69 has a length L2, equal to approximately 15 inches (38.1 cms) and six gripping sections are provided substantially equally spaced along the length of the diverter roller, and each gripping section having a length L1 of about ⅜ of an inch (0.9525 cms).

The primary idler rollers 46, 48 are each provided with a pair of mounting sections 74 and a pair of drive sections 78. The mounting sections 74 are designed to be rotatary mounted within a corresponding opening 76 provided in the adjacent side support member 54. The openings 76 are positioned on support member 54 such that the drive sections 78 of primary idler rollers are in direct contact with the drive sections 70 of diverter roller 44 and are located with respect to the entrance path 34 so that a sheet passes between the idler rollers 46, 48. The primary idler rollers 46, 48 are spaced axially apart a distance D4 so as to minimize any unnecessary contact with a sheet passing through the diverter assembly except at the nip between the diverter roller and primary idler rollers. The openings 76 each have a configuration which allow the primarily idler rollers 46, 48 to float on diverter roller 44 and be driven in response to the drive sections 78 of primary idler rollers 46, 48 contacting the drive section 70 of diverter roller 44. In the particular embodiment illustrated, the opening 76 has a generally elongated configuration orientated at an angle of about 45 degrees with respect to the vertical which allows the primary idler rollers to move up and outward with respect to the diverter roller 44.

The primary diverter rollers 46, 48 each have a main engagement section 80 disposed axially inward of drive sections 78 having a length L2. The outer surface 83 of engagement section 80 is designed to engage one side of a sheet that passes between the primary idler roller and diverter roller 44. The main engagement section 80 of each primary idler roller 46, 48 has a diameter D2 which is slightly smaller than the diameter D3 of the drive section 78. In the particular embodiment illustrated, the diameter D2 is approximately 0.04 inches smaller than the diameter D3. This provides a clearance space S between the outer surface of the gripping sections 64 and outer surface of the engagement section 83. The clearance space S is less than the thickness of a sheet designed to pass between the diverter roller 44 and its associated primary idler roller. In the particular embodiment illustrated clearance space S is about 0.002 inches (0.00508 cms) and the diverter assembly 30 is designed to receive sheets of Estar film, sold by the Eastman Kodak Company, having a thickness of about 0.0074 inches (0.0187 cms). The clearance space S minimizes any objectionable vibration that may be caused by the contact of the grooved outer engagement surface 66 of gripping sections 64 with the primary idler rollers 46, 48.

The primary idler rollers are preferably made of a material such that a sufficient degree of rigidity is imparted to the primary idler rollers so as to maintain the desired clearance space S and provide the desired reaction forces against the film. In the particular embodiment illustrated, the primary idler rollers are made of stainless steel.

The secondary idler rollers 50, 52 each comprise a central section 82 having an outer engagement surface 84, and a pair of mounting pins 86, one located at each lateral end which is designed to be rotatably mounted within a corresponding opening 88 in the adjacent side support member 54. The openings 88 are located in side support member 54 such that each secondary idler roller is in direct contact with an associated primary idler roller, and the secondary idler rollers are located with respect to the entrance path so that a sheet passes between the secondary idler rollers. The openings 88 are designed so as to allow the secondary idler rollers to freely float upon primary idler rollers 46, 48. In the particular embodiment illustrated the openings 88 have a substantially elongated configuration which allows the secondary idler rollers to move in a vertical direction and maintain the distance between the secondary idler rollers substantially constant. The lateral ends of secondary idler rollers 50, 52 are each provided with a recess section 89 to allow the adjacent drive sections 78 to freely rotate therein without contacting the secondary idler rollers. This permits the outer surface 84 of secondary idler rollers to contact the outer surface 83 of its associated primary idler roller so as to cause the secondary idler rollers to rotate in the opposite direction and at the same linear speed as a sheet passing through the diverter. To minimize cost of manufacturing the secondary idler rollers and the addition of any unnecessary weight, the secondary idler rollers 50, 52 are preferably made of an appropriate plastic material.

The float mounting of rollers 46, 48, 50 and 52 to side supports 54 allow the rollers to properly seat automatically for proper engagement therebetween and also permits the use of less costly manufacturing techniques and assembly procedures.

The axes of the secondary idler rollers 50, 52 are spaced apart a distance D5 such that the midpoint of the entrance path 34 is substantially midway between the secondary idler rollers 50, 52. The distance D5 is preferably less than the distance D4 between the primary idler rollers 46, 48 so that the secondary idler rollers provide a moving support guide for a sheet passing between the secondary idler rollers 50, 52 as discussed later in more detail.

In order to more clearly understand the present invention and its advantages, a description of its operation will now be discussed in detail. Referring to FIG. 3, the diverter roller is rotated either in a clockwise or counterclockwise direction in order to feed the sheet to either of the desired exit paths 40, 42. When it is desired to move the sheet traveling along the entrance path 34 to exit path 42, the diverter roller 44 is rotated in the clockwise direction which will cause the sheet to enter the space between diverter roller 44 and 48, and engages the surface of the diverter roller 44 anywhere between the nip defined by rollers 44, 48. The outer engaging surface 66 of gripping section 64 will deflect the sheet into the nip between rollers 44, 48 so that the sheet is driven into the exit path 42.

On the other hand, when the diverter roller 44 is driven in a counterclockwise direction, the primary idler roller 46 will be driven in a clockwise direction in which case the sheet passing between the nip defined by rollers 46 and 44 cause the sheet to be deflected into the second exit path 40.

At the same time primary idler rollers are rotating, the contacting associated secondary idler rollers will also be rotating in response thereto. When the diverter roller 44 is rotated in the clockwise direction, as illustrated in FIG. 3, the primarily idler roller 48 will rotate in the counterclockwise direction causing a sheet passing between these rollers to be deflected to exit path 42. At the same time, the secondary idler rollers are being rotated in response to the movement of its associated primary idler roller. That is, the secondary idler roller 52 will be rotating in the clockwise direction, as illustrated, whereas the secondary idler roller 50, which is associated with primary idler roller 46, will also be rotating in a clockwise direction. Since the sheet is being deflected into exit path 42, this will cause a sheet of film, or any other material, to bend in the direction illustrated by path line 90. This will result in the trailing edge of a sheet being biased against secondary idler roller 50. However, the secondary idler roller 50 is rotating such that it is moving in the same direction in which the film is moving. Since the primary idler rollers are rotating at the same linear speed as the film passing through the diverter, and the secondary idler rollers are rotating at the same speed as the primary idler rollers, the sheet will see no substantial movement between the contacting secondary idler roller. Thus, the secondary idler rollers provides a moving support guide which assists in controlling the path of a sheet passing through the diverting apparatus and minimize scratching of the film passing through the diverter assembly.

In a like manner, when the diverter roller 44 is rotated in the opposite direction, i.e. the counterclockwise direction, a sheet will be caused to be deflected to exit path 40. Thus, a sheet going through apparatus will follow the general path indicated by path 92. In this situation, the idler rollers will be rotated in the opposite direction illustrated in FIG. 4. Thus, in this mode of operation, the secondary idler roller 52 will be providing support to the trailing edge in the same manner secondary idler roller 50 provided when the sheet was passing through path line 90.

It is to be understood that any appropriate drive means may be coupled to the diverter roller for rotating the diverter roller in the desired direction as is well known to those skilled in the art.

The providing of spaced individual gripping sections improves the reliability of feeding a sheet 12 of film or other material into the desired exit path. If the sheet 12 is bowed in a direction perpendicular to the axis of the diverter roller, the leading edge of the sheet will be allowed to freely engage the individual grooves in the outer engaging surface 66 of each gripping section 64. The providing of relatively narrow gripping sections minimizes the potential stubbing problem by greatly reducing the opportunity of the film to be supported by the outside diameter of the roller.

An additional advantage of the present invention is that the secondary idler rollers provide a moving support which minimizes or eliminates potential scratching caused by fixed guides used to control the movement of the film.

In the preferred embodiment illustrated the gripping sections 64 are integrally formed on the primary idler rollers. It is to be understood that gripping sections may be provided in any desired manner. For example, the gripping sections may be made in the form of a small endless loop, like a small rubber band, with the grooves formed on the outer surface. The endless loop would have a inner diameter smaller than the outer diameter of a supporting cylindrical core on which it is to be placed. The desired number of loops are simply place on the supporting core at the desired positions. If necessary locking means may be provided to prevent the endless from slipping around the support core.

It is to be understood that various other modifications may be made without departing from the scope of the present invention. The present invention being limited by the following claims.

What is claimed is:

1. A diverting apparatus for diverting successive sheets from an entrance path in one of two directions, comprising:

a driven diverter roller having a plurality of spaced gripping sections, each of the gripping sections having an outer engaging surface, the outer engaging surface of each of said gripping sections having means for urging the sheets through said diverter apparatus; and a pair of spaced primary idler rollers each being in direct contact with said driven diverter roller so as to cause the primary idler rollers to rotate in the opposite direction said diverter roller is rotated, the primary idler rollers being located with respect to the entrance path so that a sheet traveling along the entrance path passes between the primary idler rollers.

2. A diverting apparatus according to claim 1 wherein said driven diverter roller further comprises at least one drive section disposed axially outward of the area the sheets pass along said driven diverter roller.

3. A diverting apparatus according to claim 2 wherein said gripping sections are made of a material having a high coefficient of friction.

4. A diverting apparatus according to claim 1 wherein said plurality of spaced gripping sections comprises at least three.

5. A diverting apparatus according to claim 1 wherein said gripping sections each have an axial length of about ⅜ of an inch (0.9525 cms).

6. A diverting apparatus according to claim 1 wherein said plurality of gripping sections comprises six.

7. The diverting apparatus according to claim 1 wherein each of said plurality of gripping section having an axial length no greater than about 10% of the width of a sheet passing through the diverting apparatus.

8. A diverting apparatus according to claim 1 wherein said means for urging said sheets through said diverting apparatus comprises a plurality of grooves formed in the outer engaging surface of said gripping sections.

9. A diverting apparatus according to claim 8 wherein said plurality of grooves provided on each of said gripping sections comprises 24.

10. A diverting apparatus according to claim 2 wherein each of said primary idler rollers have at least one drive section and a sheet engagement section, said drive section on said primary idler roller being designed to engage said at least one drive section on said driven diverter roller, said sheet engagement section having a smaller outer diameter than said at least one drive section such that a clearance space is provided between said sheet engagement section and the outer engaging surface of said gripping sections.

11. A diverting apparatus for diverting successive sheets from an entrance path in one of two exit paths, comprising:

a diverter roller having a plurality of spaced gripping sections, each of the gripping sections having an outer engaging surface, the outer engaging surface of each of said gripping sections having means for urging the sheets through the diverting apparatus;

a pair of spaced primary rollers each being in direct contact with said diverter roller so as to cause the primary rollers to rotate in the opposite direction said diverter roller is rotated, the primary rollers being located with respect to the entrance path so that a sheet traveling along the entrance path passes between the primary rollers; and drive means coupled to the diverter roller for rotating the diverter roller about its axis in (1) a first direction to deflect a sheet traveling along the entrance path between the primary idler rollers into a nip between the diverter roller and a first one of the primary idler rollers and into one of the exit paths or (2) a second direction to deflect a sheet traveling along the entrance path between the primary idler rollers into a second nip between the diverter roller and a second one of the primary idler rollers and into the other of the exit paths.

12. A diverter roller for use in a diverting apparatus for diverting successive sheets from an entrance path in one of two directions, the diverting apparatus having at least one idler roller in direct contact with said diverter roller so as to cause said at least one idler roller to rotate in the opposite direction said diverter roller rotates, said diverter roller comprising a plurality of spaced gripping sections, each of the gripping sections having an outer engaging surface, the outer engaging surface of each of said gripping sections having means for urging said sheets through said diverting apparatus, said diverter roller having a drive section disposed axially outward of the area the sheet passes along said diverter roller and the drive section having a configuration such that it contacts the adjacent at least one idler roller so as to provide a clearance space between the outer surface of the gripping section with respect to the adjacent at least one idler roller.

13. A diverter roller according to claim 12 wherein said gripping sections are made of a material having a high coefficient of friction.

14. A diverter roller according to claim 12 wherein said plurality of spaced gripping sections comprises at least three.

15. A diverter roller according to claim 12 wherein said gripping sections each have an axial length of about ⅜ of an inch (0.9525 cms).

16. A diverter roller according to claim 12 wherein said plurality of gripping sections comprises six.

17. A diverter roller according to claim 12 wherein each of said plurality of gripping section having an axial length no greater than about 10% of the width of a sheet passing through the diverting apparatus.

18. A diverter roller according to claim 12 wherein said means for urging said sheets through said diverting apparatus comprises a plurality of grooves formed in the outer engaging surface of said gripping sections.

19. A diverter roller according to claim 18 wherein said plurality of grooves provided on each of said gripping sections comprises 24.

* * * * *